US006661984B2

(12) United States Patent
Kojima

(10) Patent No.: US 6,661,984 B2
(45) Date of Patent: Dec. 9, 2003

(54) IMAGE FORMING APPARATUS

(75) Inventor: Shinichi Kojima, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/180,335

(22) Filed: Jun. 27, 2002

(65) Prior Publication Data

US 2003/0016975 A1 Jan. 23, 2003

(30) Foreign Application Priority Data

Jun. 28, 2001 (JP) ..... 2001-196906
May 23, 2002 (JP) ..... 2002-149168

(51) Int. Cl.[7] ..... G03G 15/00

(52) U.S. Cl. ..... 399/110; 399/107; 399/384; 399/393

(58) Field of Search ..... 399/107, 110, 399/113, 384, 391, 393; 271/9.01, 9.1, 145

(56) References Cited

U.S. PATENT DOCUMENTS 5,157,448 A * 10/1992 Lang ..... 399/393 X
5,191,382 A * 3/1993 Okamura et al. ..... 399/107
5,270,772 A * 12/1993 Akiyama ..... 399/110
5,666,595 A * 9/1997 Sameshima et al. ..... 399/110
5,701,573 A * 12/1997 Yoshiuchi et al. ..... 399/384
5,926,671 A * 7/1999 Leibman ..... 399/110
6,481,081 B1 * 11/2002 Kilian ..... 399/113 X

FOREIGN PATENT DOCUMENTS

JP 6-242641 9/1994

* cited by examiner

*Primary Examiner*—Sandra Brase
(74) *Attorney, Agent, or Firm*—Oblon, Spivak, McClelland, Maier & Neustadt, P.C.

(57) ABSTRACT

An image forming apparatus of the present invention is generally made up of a sheet storing unit and an image forming unit removably mounted on the top of the sheet storing unit when in use. The sheet storing unit accommodates a sheet tray loaded with sheets and selectively movable into the sheet storing unit to an operative position or out of the same to an inoperative position. A locking mechanism inhibits the sheet tray from being moved to the inoperative position. An unlocking device unlocks the locking mechanism when the image forming unit is mounted to the sheet storing unit. When the image forming unit is removed from the sheet storing unit, the sheet storing unit is prevented from falling down due to a moment ascribable to the pull-out of the sheet tray.

15 Claims, 5 Drawing Sheets

IMAGE FORMING APPARATUS

BACKGROUND OF THE INVENTION

1. Field of the Invention

The present invention relates to an image forming apparatus of the type having a sheet storing unit accommodating a sheet tray, which is movable between an operative position and an inoperative position, and an image forming unit removably mounted on the top of the sheet storing unit when in use.

2. Description of the Background Art

An image forming apparatus of the type described is known in the art and made up of a sheet storing unit and an image forming unit removably mounted on the top of the sheet storing unit when in use. The sheet storing unit includes a sheet tray loaded with sheet rolls. A sheet selectively paid out from either one of the sheet rolls is fed to the image forming unit. The sheet tray is selectively slidable into the sheet storing unit to an operative position or out of the sheet storing unit to an inoperative position in substantially the horizontal direction.

The conventional image forming apparatus of the type described has the following problem unsolved. When the image forming apparatus is newly purchased and installed at the user's station or when it is moved to another place, the image forming unit is absent on the sheet storing unit. Assume that in such a condition a person pulls out the sheet tray loaded with the sheet rolls or loads the sheet rolls in the sheet tray pulled out. Then, a heavy moment of rotation ascribable to the sheet tray acts on the sheet storing unit and is apt to cause the sheet storing unit to falldown.

Technologies relating to the present invention are disclosed in, e.g., Japanese Patent Laid-Open Publication No. 6-242641.

SUMMARY OF THE INVENTION

It is an object of the present invention to provide an image forming apparatus capable of preventing a sheet storing unit thereof from falling down in the absence of an image forming unit due to a moment generated when a person pulls out a sheet tray loaded with sheets or replenishes sheets to the sheet tray pulled out.

An image forming apparatus of the present invention is generally made up of a sheet storing unit and an image forming unit removably mounted on the top of the sheet storing unit when in use. The sheet storing unit accommodates a sheet tray loaded with sheets and selectively movable into the sheet storing unit to an operative position or out of the same to an inoperative position. A locking mechanism inhibits the sheet tray from being moved to the inoperative position. An unlocking device unlocks the locking mechanism when the image forming unit is mounted to the sheet storing unit.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
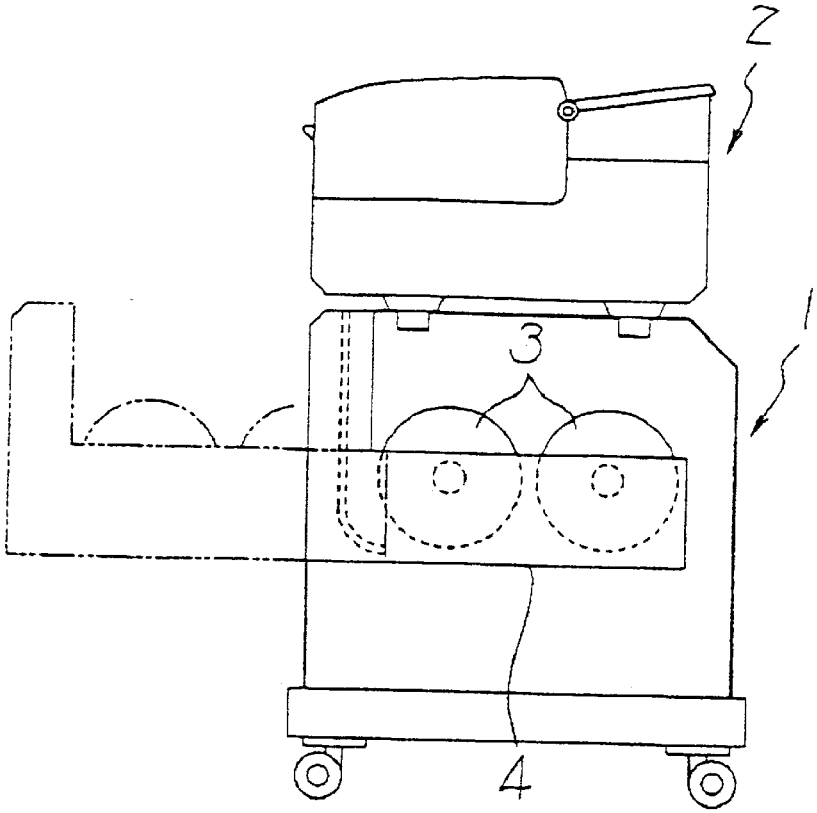
FIG. 1 PRIOR ART
FIG. 1 is a front view showing a conventional image forming apparatus in a usable condition.
Figure 2:
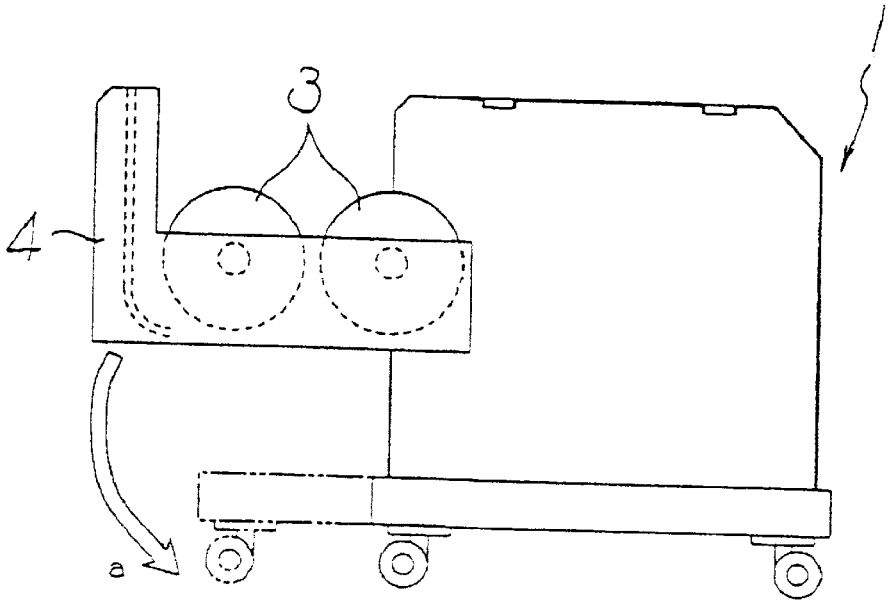
FIG. 2 PRIOR ART
FIG. 2 is a front view showing a sheet storing unit included in the apparatus of FIG. 1 in a condition wherein a sheet tray is pulled out of the sheet storing unit.

To better understand the present invention, brief reference will be made to a conventional image forming apparatus, shown in FIG. 1. As shown, the image forming apparatus is generally made up of a sheet storing unit 1 and an image forming unit 2 removably mounted on the top of the sheet storing unit 1 when in use. The sheet storing unit 1 includes a sheet tray 4 loaded with sheet rolls 3. A sheet selectively paid out from the sheet rolls 3 is fed to the image forming unit 2. The sheet tray 4 is selectively slidable into the sheet storing unit 1 to an operative position or out of the sheet storing unit 1 to an inoperative position in substantially the horizontal direction. The operative position and inoperative position are respectively indicated by a solid line and a dash-and-dots line in FIG. 1; the inoperative position is indicated by a solid line in FIG. 2.

As for weight, the image forming unit 2 is heavy because it accommodates an image forming mechanism including a photoconductive element and a heat roller. By contrast, the sheet storing unit 1 is a simple casing having a space in which the sheet tray 4 is disposed, and is therefore light. The sheet tray 4 is also light, but becomes heavy when loaded with the sheet rolls 3. As shown in FIG. 1, when the image forming unit 2 is mounted on the sheet storing unit 1 when in use, the weight of the heavy image forming unit 2 acts on the sheet storing unit 1 vertically downward. Therefore, when the sheet tray 4 loaded with the sheet rolls 3 is pulled out to the inoperative position or when the sheet rolls 3 are replenished to the sheet tray 4 pulled out, the image forming unit 2 does not fall down despite a heavy moment of rotation acting thereon due to the sheet tray 4 and remains stable on the sheet feeding unit 1.

On the other hand, when the image forming apparatus is newly purchased and installed at the user's station or when it is moved to another place, the image forming unit 2 is absent on the sheet storing unit 1. Assume that in such a condition a person pulls out the sheet tray 4 loaded with the sheet rolls 3 or loads the sheet rolls 3 in the sheet tray 4 pulled out. Then, a heavy moment of rotation ascribable to the sheet tray 4 acts on the sheet storing unit 1 and is apt to cause the sheet storing unit 1 to fall down in a direction indicated by an arrow a in FIG. 2. To solve this problem, the leg portion of the sheet storing unit 1 may be extended outward in the direction in which the sheet tray 4 is slidable, as indicated by a dash-and-dots line in FIG. 2. However, the extended leg portion increases the floor area to be occupied by the image forming apparatus and is likely to trip up the operator's foot.

Figure 3:
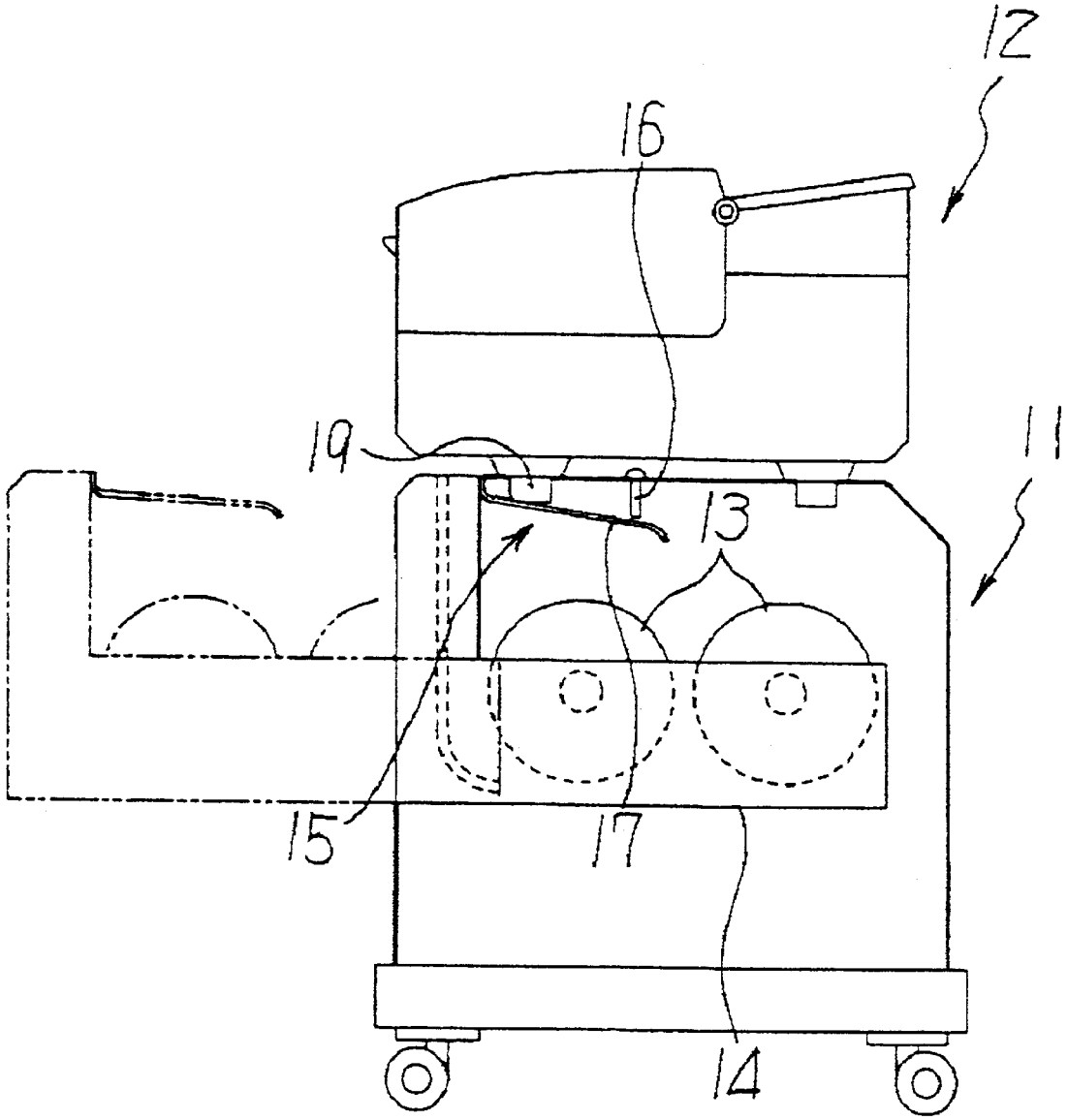
FIG. 3 is a front view showing an image forming apparatus embodying the present invention.
Figure 4:
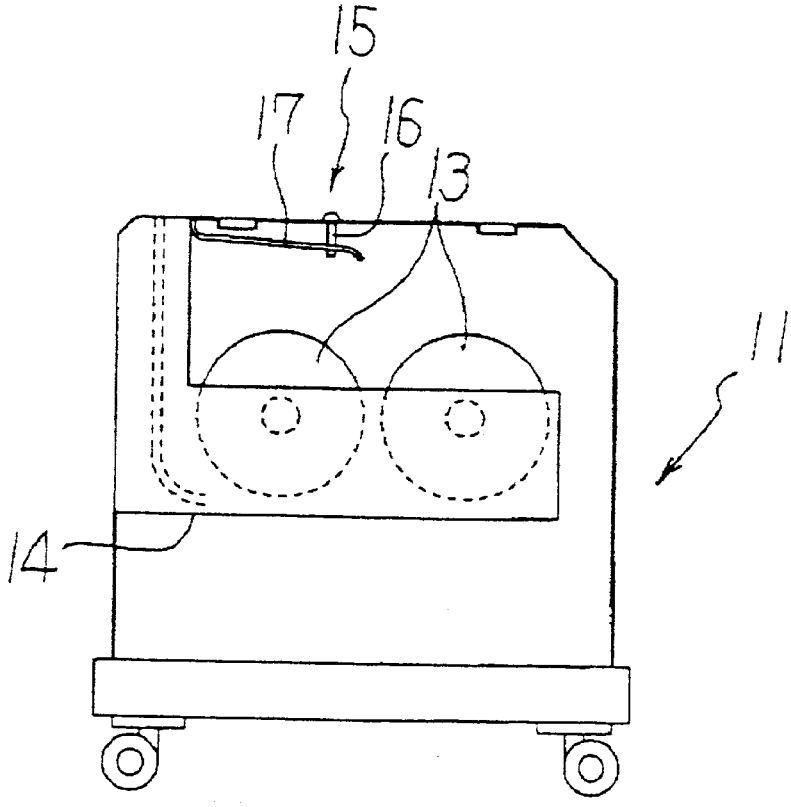
FIG. 4 is a front view showing a sheet storing unit included in the illustrative embodiment.
Figure 5:
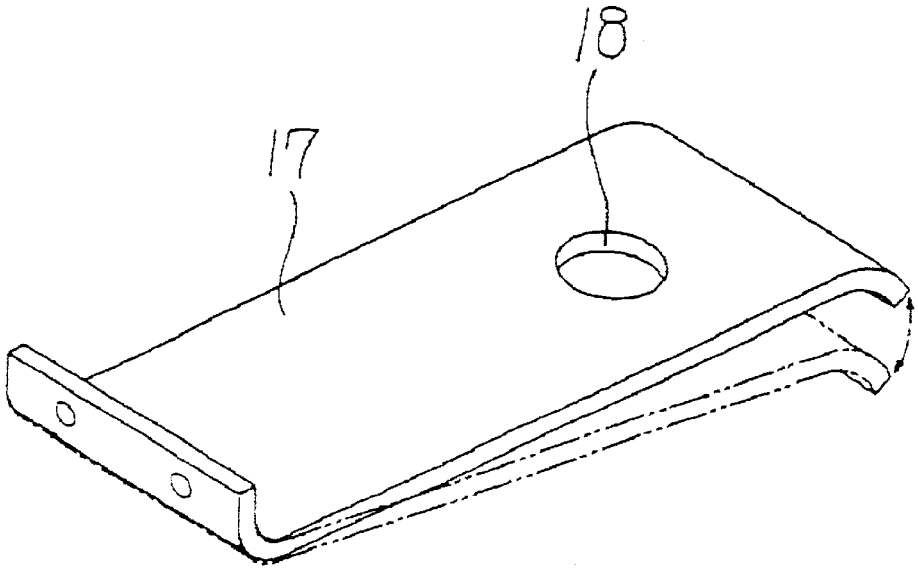
FIG. 5 is an isometric view showing a leaf spring forming part of a locking mechanism included in the illustrative embodiment.

Referring to FIGS. 3 through 5, an image forming apparatus embodying the present invention is shown and generally made up of a sheet storing unit 11 and an image forming unit 12 removably mounted on the top of the sheet storing unit 11 when in use. The image forming unit 12 is so sized as to be capable of forming images on sheets of relatively large sizes including sizes A0 and A1.

Again, the image forming unit 12 accommodates an image forming mechanism including a photoconductive element and a heat roller and is therefore heavy. The sheet storing unit 11 includes a sheet tray 14 loaded with sheet rolls 13. A sheet selectively paid out from the sheet rolls 13 is fed to the image forming unit 12. The sheet tray 14 is selectively slidable into the sheet storing unit 11 to an operative position or out of the sheet storing unit 11 to an inoperative position in substantially the horizontal direction. The operative position and inoperative position are respectively indicated by solid lines in FIGS. 3 and 4 and a dash-and-dots line in FIG. 3. The sheet storing unit 11 is a simple casing having a space in which the sheet tray 14 is disposed, and is therefore light. The sheet tray 14 is also light, but becomes heavy when loaded with the sheet rolls 13.

A locking mechanism 15 is arranged in the upper portion of the sheet storing unit 11 for locking the sheet tray 14 at the operative position to thereby prevent it from being slid to the inoperative position. The locking mechanism 15 is implemented by a projection or first engaging portion 16 and a leaf spring or locking member 17. The projection 16 is affixed to the top wall of the sheet storing unit 11 and extends downward. The leaf spring 17 is affixed to the sheet tray 4 and formed with a hole or second engaging portion 18 configured to mate with the projection 16. The leaf spring 17 is resiliently deformable between a locking position where it mates with the projection 16 and an unlocking position where it is released from the projection 16. The leaf spring 17 is constantly biased toward the locking position.

A plurality of legs protrude downward from the bottom of the image forming unit 12. One of the legs, labeled 19, plays the role of a pressing member or unlocking member for unlocking the locking mechanism 15. More specifically, when the image forming unit 12 is mounted to the sheet storing unit 11, the leg 19 presses the leaf spring 17 downward to the unlocking position.

In FIG. 3, the image forming apparatus is shown in a condition for use, as indicated by solid lines. In this condition, the image forming unit 12 is mounted on the top of the sheet storing unit 11 and ready to receive the sheet 13 from the sheet feeding unit 11 for forming an image. The leaf spring 17 is pressed downward by the leg 19 out of engagement with the projection 16. The sheet tray 14 can therefore freely slide from the operative position to the inoperative position without being restricted by the locking mechanism 15. The sheet tray 14 will be pulled out to the inoperative position when the roll sheets 13 should be replaced with roll sheets of different sizes, when the sheet rolls 13 should be replenished or when the sheet tray 14 should be maintained in the event of, e.g., a sheet jam.

So long as the image forming unit 12 is mounted on the sheet storing unit 11 for use, the weight of the heavy image forming unit 12 acts on the sheet storing unit 11 vertically downward. Therefore, when the sheet tray 14 loaded with the sheet rolls 13 is pulled out to the inoperative position or when the sheet rolls 13 are replenished to the sheet tray 14 so pulled out, the image forming unit 12 does not fall down despite a heavy moment of rotation acting thereon due to the sheet tray 14 and remains stable on the sheet feeding unit 11.

Assume that the image forming unit 12 is removed from the top of the sheet storing unit 11 when the image forming apparatus is newly purchased and installed at the user's station or when it is moved to another place. Then, as shown in FIG. 4, the leaf spring 17 resiliently deforms upward to the locking position where the hole 18 mates with the projection 16 due to the absence of the leg 19, thereby locking the locking mechanism 15. In this condition, the sheet tray 14 is inhibited from sliding out of the sheet feeding unit 11 and maintained in the operative position. More specifically, when the image forming unit 12 is absent on the sheet storing unit 11, the locking mechanism 15 inhibits a person from pulling the sheet tray 14 out of the sheet storing unit 11. This successfully obviates a moment that would cause the sheet storing unit 11 to fall down due to the displacement of the center of gravity.

Further, the illustrative embodiment does not need the extension of the leg portion described in relation to the conventional image forming apparatus and therefore saves space and obviates the previously stated accident.

The hole 18 of the leaf spring 17 and the projection 16 may be replaced with each other, if desired. Further, the projection 16 and leaf spring 17 may alternatively be affixed to the sheet tray 14 and sheet storing unit 11, respectively. Moreover, the leaf spring 17 may be removably mounted to the sheet tray 14, i.e., it may be detached after the image forming unit 12 has been mounted to the sheet storing unit 11 and attached before the former is dismounted from the latter. In addition, the sheet rolls 13 loaded on the sheet tray 14 may, of course, be replaced with cut sheets of a preselected size.

Figure 6:
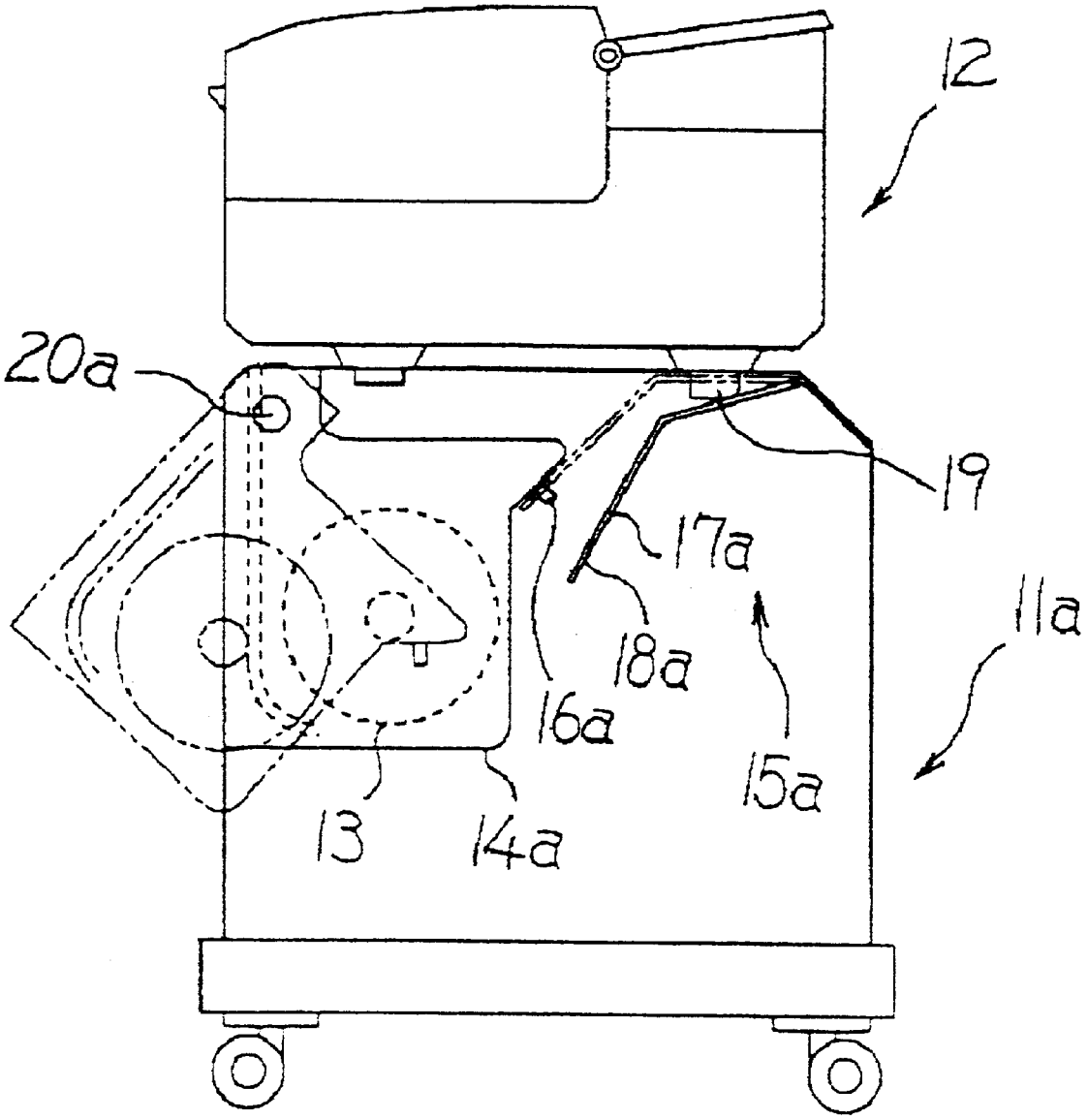
FIG. 6 is a front view showing an alternative embodiment of the present invention.

An alternative embodiment of the present invention will be described with reference to FIG. 6. In FIG. 6, structural elements identical with those shown in FIGS. 2 through 5 are designated by identical reference numerals and will not be described specifically in order to avoid redundancy. As shown, the image forming apparatus is generally made up of a sheet storing unit 11*a* and the image forming unit 12 removably mounted on the sheet storing unit 11*a* when in use. Again, the image forming unit 12 is so sized as to be capable of forming images on sheets of relatively large sizes including sizes A0 and A1.

The sheet storing unit 11*a* includes a sheet tray 14*a* loaded with a sheet roll 13. In the illustrative embodiment, the sheet tray 14*a* is angularly movable about a shaft 20*a* extending in the horizontal direction. The sheet tray 14*a* is selectively movable about the shaft 20*a* into the sheet storing unit 11*a* to an operative position or out of the sheet storing unit 11*a* to an inoperative position. The operative position and inoperative position are respectively indicated by a solid line and a dash-and-dots line in FIG. 6. The shaft 20*a* is positioned above the sheet tray 14*a*.

The sheet storing unit 11*a* is a simple casing having a space in which the sheet tray 14*a* is disposed, and is therefore light. The sheet tray 14*a* is also light, but becomes heavy when loaded with the sheet rolls 13.

A locking mechanism 15*a* is arranged in the upper portion of the sheet storing unit 11*a* for locking the sheet tray 14*a* at the operative position to thereby prevent it from being slid to the inoperative position. The locking mechanism 15*a* is implemented by a projection or first engaging portion 16*a* and a leaf spring or locking member 17*a*. The projection 16*a* protrudes obliquely downward from the sheet tray 14*a*. The leaf spring or locking member 17*a* is affixed to the sheet storing unit 11*a* and formed with a hole or second engaging portion 18*a* configured to mate with the projection 16*a*. The leaf spring 17*a* is resiliently deformable between a locking position where it mates with the projection 16*a* and an unlocking position where it is released from the projection 16*a*. The leaf spring 17*a* is constantly biased toward the locking position.

In FIG. 6, the image forming apparatus is shown in a condition for use, as indicated by solid lines. In this condition, the image forming unit 12 is mounted on the top of the sheet storing unit 11*a* and ready to receive the sheet 13 from the sheet feeding unit 11*a* for forming an image. The leaf spring 17*a* is pressed downward by the leg 19 of the image forming unit 12 out of engagement with the projection 16*a*. The sheet tray 14*a* can therefore freely move about the shaft 20*a* out of the sheet feeding unit 11*a* without being restricted by the locking mechanism 15*a*.

So long as the image forming unit 12 is mounted on the sheet storing unit 11*a* for use, the weight of the heavy image forming unit 12 acts on the sheet storing unit 11*a* vertically downward. Therefore, when the sheet tray 14*a* loaded with the sheet roll 13 is pulled out to the inoperative position or when the sheet roll 13 is replenished to the sheet tray 14*a* pulled out, the image forming unit 12 does not fall down despite a heavy moment of rotation acting thereon due to the sheet tray 14*a* and remains stable on the sheet feeding unit 11*a*.

Assume that the image forming unit 12 is removed from the top of the sheet storing unit 11*a* when the image forming apparatus is newly purchased and installed at the user's station or when it is moved to another place. Then, the leaf spring 17*a* resiliently deforms upward to the locking position where the hole 18*a* mates with the projection 16*a*due to the absence of the leg 19, thereby locking the locking mechanism 15*a*. In this condition, the sheet tray 14*a* is inhibited from sliding out of the sheet feeding unit 11*a* and maintained in the operative position. More specifically, when the image forming unit 12 is absent on the sheet storing unit 11*a*, the locking mechanism 15*a* inhibits a person from pulling the sheet tray 14*a* out of the sheet storing unit 11*a*. This successfully obviates a moment that would cause the sheet storing unit 11*a* to fall down due to the displacement of the center of gravity.

Further, the illustrative embodiment, like the previous embodiment, does not need the extension of the leg portion described in relation to the conventional image forming apparatus and therefore saves space and obviates the previously stated accident.

Figure 7:
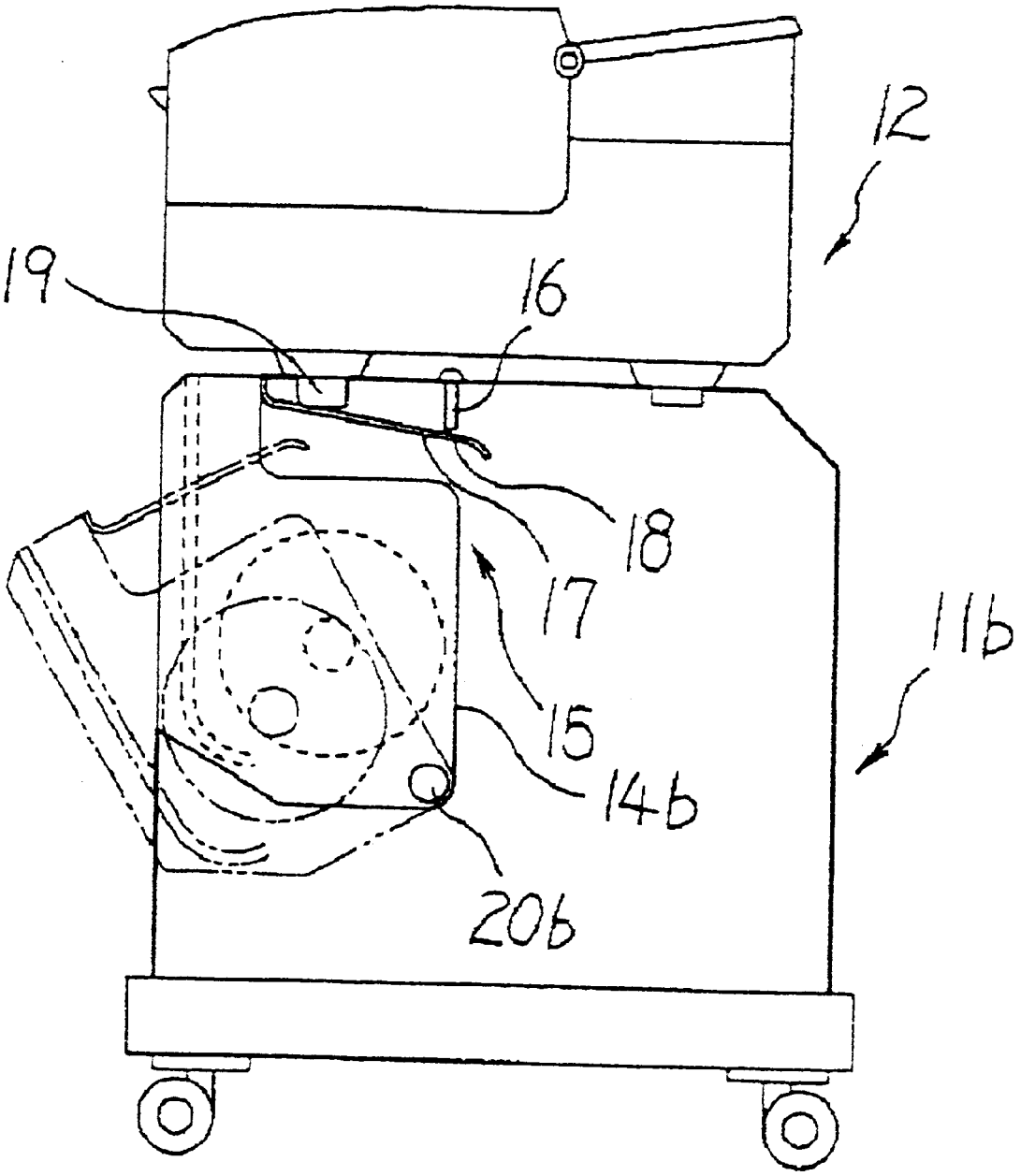
FIG. 7 is a front view showing another alternative embodiment of the present invention.

FIG. 7 shows another alternative embodiment of the present invention. As shown, the image forming apparatus is generally made up of a sheet storing unit 11*b* and the image forming unit 12 removably mounted on the sheet storing unit 11*b* when in use. Again, the image forming unit 12 is so sized as to be capable of forming images on sheets of relatively large sizes including sizes A0 and A1.

The sheet storing unit 11*b* includes a sheet tray 14*b* loaded with the sheet roll 13. In the illustrative embodiment, the sheet tray 14*b* is angularly movable about a shaft 20*b* extending in the horizontal direction. The sheet tray 14*b* is selectively movable about the shaft 20*b* into the sheet storing unit 11*b* to an operative position or out of the sheet storing unit 11*b* to an inoperative position. The operative position and inoperative position are respectively indicated by a solid line and a dash-and-dots line in FIG. 7. The shaft 20*b* is positioned above the sheet tray 14*b*.

The sheet storing unit 11*b* is a simple casing having a space in which the sheet tray 14*b* is disposed, and is therefore light. The sheet tray 14*b* is also light, but becomes heavy when loaded with the sheet rolls 13.

The illustrative embodiment also includes the locking mechanism 15 arranged in the upper portion of the sheet storing unit 11*b*. The locking mechanism 15 is identical in configuration and operation with the locking mechanism 15 described with reference to FIGS. 3 through 5 and will not be described specifically in order to avoid redundancy.

In summary, in accordance with the present invention, an image forming apparatus is made up of a sheet storing unit and an image forming unit removably mounted on the sheet storing unit when in use. When the image forming unit is removed from the sheet storing unit, the sheet storing unit is prevented from falling down due to a moment ascribable to the pull-out of a sheet tray. This can be done with a simple locking mechanism, a first and a second engaging portion simple in configuration, simple unlocking means without resorting to an exclusive pressing member, which would increase the cost of the apparatus.

Various modifications will become possible for those skilled in the art after receiving the teachings of the present disclosure without departing from the scope thereof.

What is claimed is:

1. An image forming apparatus comprising:

a sheet storing unit comprising a sheet tray loaded with a sheet and selectively movable into said sheet storing unit to an operative position or out of said sheet storing unit to an inoperative position;

an image forming unit removably mounted on a top of said sheet storing unit when in use;

a locking mechanism configured to inhibit said sheet tray from being moved to the inoperative position; and unlocking means configured to unlock said locking mechanism when said image forming unit is mounted on said sheet storing unit.

2. The apparatus as claimed in claim 1, wherein said sheet storing unit is slidable in a horizontal direction.

3. The apparatus as claimed in claim 2, wherein said locking mechanism comprises:

a first engaging portion included in one of said sheet storing unit and said sheet tray;

a second engaging portion included in the other of said sheet storing unit and said sheet tray; and a locking member elastically deformable between a locking position in which said second engaging portion mates with said first engaging portion and an unlocking position in which said second engaging portion leaves said first engaging portion, said locking member being constantly biased toward said locking position.

4. The apparatus as claimed in claim 3, wherein one of said first engaging portion and said second engaging portion comprises a projection while the other of said first engaging portion and said second engaging portion comprises a hole.

5. The apparatus as claimed in claim 4, wherein said unlocking means comprises a pressing member included in said image forming unit for pressing said locking member toward the unlocking position.

6. The apparatus as claimed in claim 5, wherein said pressing member comprises a leg protruding downward from a bottom of said image forming unit.

7. The apparatus as claimed in claim 1, wherein said sheet storing unit is angularly movable about a horizontal shaft.

8. The apparatus as claimed in claim 7, wherein said locking mechanism comprises:

a first engaging portion included in either one of said sheet storing unit and said sheet tray;

a second engaging portion included in the other of said sheet storing unit and said sheet tray; and a locking member elastically deformable between a locking position in which said second engaging portion mates with said first engaging portion and an unlocking position in which said second engaging portion leaves said first engaging portion, said locking member being constantly biased toward said locking position.

9. The apparatus as claimed in claim 8, wherein one of said first engaging portion and said second engaging portion comprises a projection while the other of said first engaging portion and said second engaging portion comprises a hole.

10. The apparatus as claimed in claim 9, wherein said unlocking means comprises a pressing member included in said image forming unit for pressing said locking member toward the unlocking position.

11. The apparatus as claimed in claim 10, wherein said pressing member comprises a leg protruding downward from a bottom of said image forming unit.

12. The apparatus as claimed in claim 1, wherein said locking mechanism comprises:

a first engaging portion included in either one of said sheet storing unit and said sheet tray;

a second engaging portion included in the other of said sheet storing unit and said sheet tray; and a locking member elastically deformable between a locking position in which said second engaging portion mates with said first engaging portion and an unlocking position in which said second engaging portion leaves said first engaging portion, said locking member being constantly biased toward said locking position.

13. The apparatus as claimed in claim 12, wherein one of said first engaging portion and said second engaging portion comprises a projection while the other of said first engaging portion and said second engaging portion comprises a hole.

14. The apparatus as claimed in claim 13, wherein said unlocking means comprises a pressing member included in said image forming unit for pressing said locking member toward the unlocking position.

15. The apparatus as claimed in claim 14, wherein said pressing member comprises a leg protruding downward from a bottom of said image forming unit.

* * * * *